United States Patent [19]

Cau et al.

[11] 4,179,307

[45] Dec. 18, 1979

[54] DISH-WASHER CONSISTING OF AN ASSEMBLY OF FUNCTIONAL UNITS MADE OF THERMOPLASTIC MATERIAL

[75] Inventors: Pasqualino Cau, Oggiono; Vincenzo Cocca, Cormano, both of Italy

[73] Assignee: Montedison S.p.A., Milan, Italy

[21] Appl. No.: 906,195

[22] Filed: May 15, 1978

[30] Foreign Application Priority Data

May 13, 1977 [IT] Italy ..... 23537 A/77

[51] Int. Cl.[2] ..... B08B 3/02

[52] U.S. Cl. ..... 134/58 D; 134/105; 134/115 R; 134/143; 134/148; 134/165; 134/175

[58] Field of Search ..... 134/57 D, 58 D, 105, 134/115 R, 115 G, 143–145, 148, 151, 165, 175–177, 179

[56] References Cited

U.S. PATENT DOCUMENTS

| | | | |
|---|---|---|---|
| 2,632,452 | 3/1953 | Spitzer | 134/176 X |
| 3,103,227 | 9/1963 | Long | 134/105 X |
| 3,363,637 | 1/1968 | Rumbaugh et al. | 134/115 R X |
| 3,410,116 | 11/1968 | Levinson | 134/115 R X |
| 3,538,927 | 11/1970 | Wallgren | 134/144 |
| 3,590,863 | 7/1971 | Faust et al. | 134/144 |
| 3,718,149 | 2/1973 | Mazza | 134/57 D |
| 4,064,887 | 12/1977 | Geiger et al. | 134/144 |

*Primary Examiner*—Robert L. Bleutge

*Attorney, Agent, or Firm*—Stevens, Davis, Miller & Mosher

[57] ABSTRACT

A dish-washing machine composed of thermoplastic material comprising an inner enclosure fitting within but spaced from an outer enclosure, and a plurality of functional units. The functional units include a dish-carrying drawer unit having a rotor mounted within the inner enclosure, an electrical control unit mounted in the space between the upper end of the inner enclosure and the outer enclosure, and an hydraulic unit located in the space between the lower end of the inner enclosure and the outer enclosure. A vapor condenser is located within the space between the inner and outer enclosures for condensing steam passing through holes in the inner enclosure.

8 Claims, 5 Drawing Figures

DISH-WASHER CONSISTING OF AN ASSEMBLY OF FUNCTIONAL UNITS MADE OF THERMOPLASTIC MATERIAL

The present invention concerns a dishwasher completely made of thermoplastic material and conceived as an assembly of functional blocks or units produced separately by means of known molding techniques.

Object of this invention is that of providing dishwasher of plastic material consisting in a simple and fast assembling of just a few functional units obtained by pressure molding, pre-arranged and/or wired separately, and housed in a cabinet likewise obtained by pressure molding, provided with bays and ducts suited for receiving single functional blocks or units with the corresponding piping and wiring, so as to obtain an electrical dishwasher totally made of plastic material, of great functionality and of low cost.

Another object of the invention is that of providing a functionally and structurally improved dishwasher that is capable of eliminating the emission of bad-smelling vapors, of facilitating the loading and unloading of the kitchenware, the charging of the detergent, and whose operation is more noiseless than the conventional dishwashers made of metal.

These objects and the corresponding advantages are practically achieved by a dishwasher of thermoplastic material consisting, according to the invention, of an assembly of functional blocks or units obtained separately according to known fabrication techniques by compression molding, said assembly of the different units comprising: a housing or cabinet unit with a central dish-carrying bay, an upper space or bay for the electrical controls and for the small detergent basins, and a lower space or bay for the hydraulic unit, as well as ducts for the conveyance of the water, a steam condenser, a hydraulic unit incorporating places for the pumps and electrovalves, basins for the salt and the ionexchanging resin, and the necessary water inlet and distributing conduits; an electrical unit comprising places for the timers and the various switches, as well as places for the basins for the detergent and the polish; and finally two dish-carrying drawer units complete with rotor and corresponding feed ducts, the hydraulic unit being inserted in said lower bay of the cabinet, while the electrical control unit, pre-wired on the bench, is inserted into the upper bay, while the two dish-carrying drawers are slidably inserted into the central bay of the cabinet.

The structural and functional characteristics of the dishwasher of this invention, will in the following be described in detail with the help of and reference to the hereto attached drawings, given for purely illustrative and not limiting purposes, in which.

Figure 1:
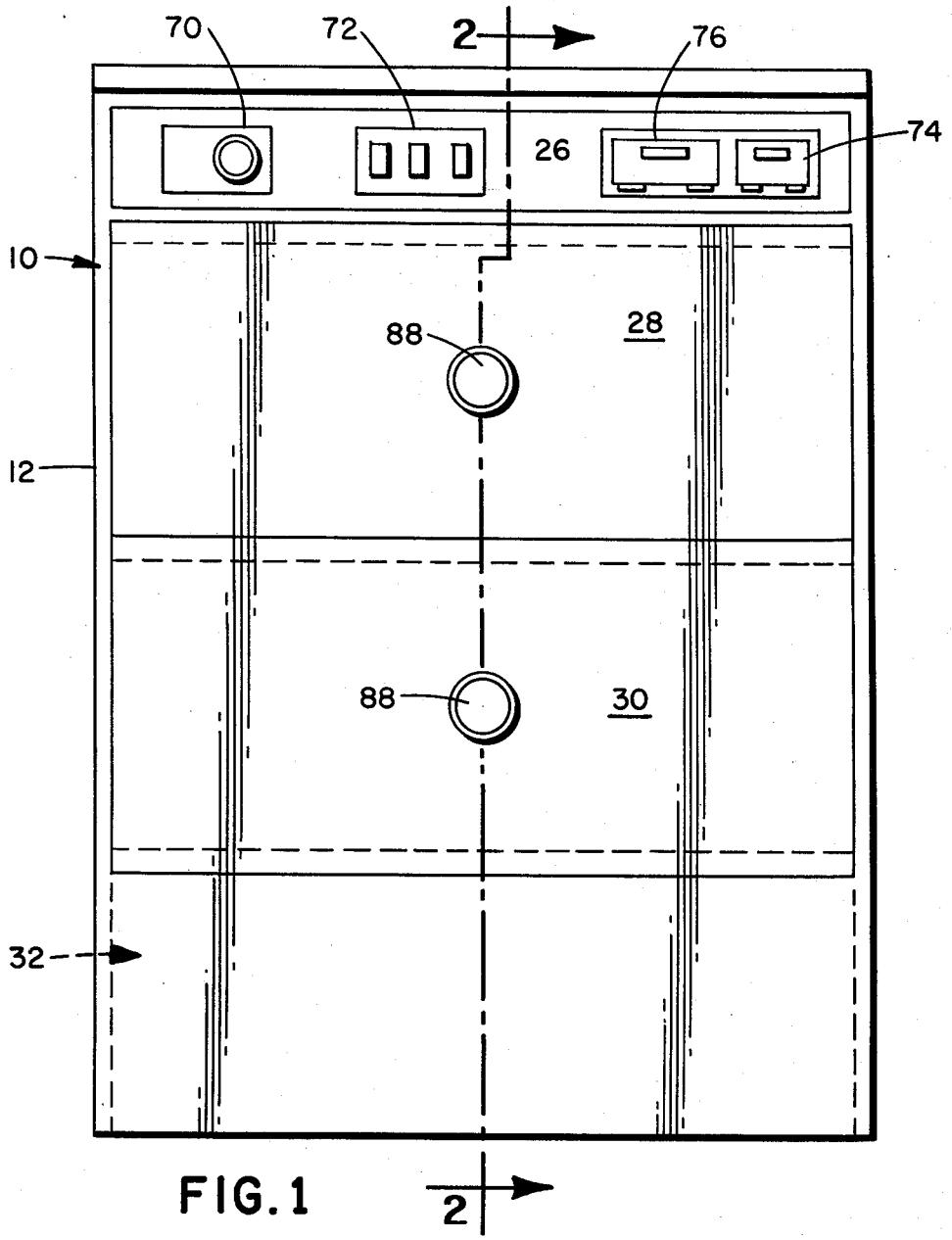
FIG. 1 is a front elevational view of the dish-washer according to the invention.
Figure 2:
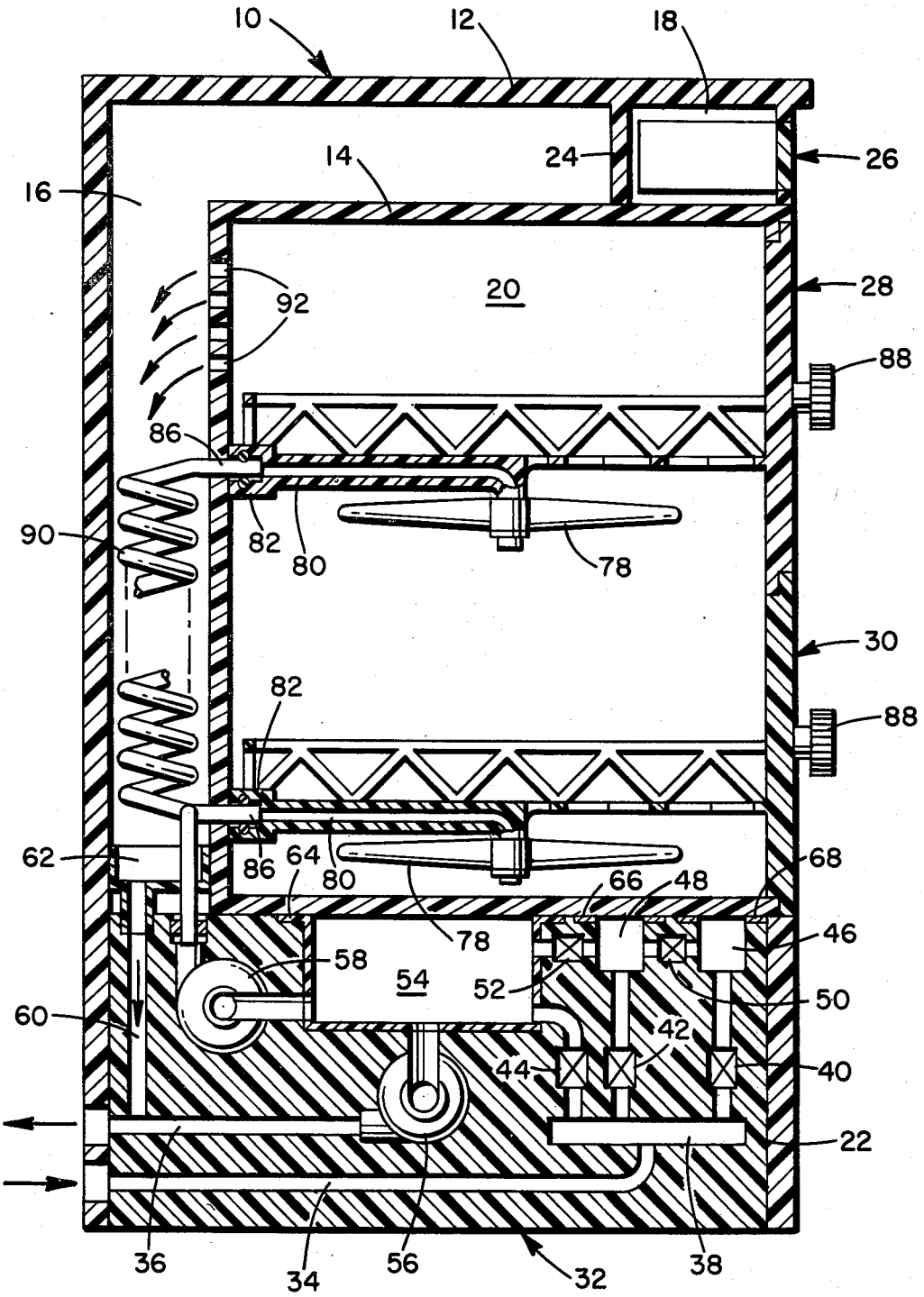
FIG. 2 is a vertical sectional view showing the internal structure of the dish-washer and taken along line 2—2 of FIG. 1.

With reference to these figures, and in particular to FIGS. 1 and 2, the dish-washer, completely made of thermoplastic material, is an assembly of 5 functional units, obtained separately by means of conventional thermoplastic transformation techniques (i.e.: injection molding, sandwich forming, rotational molding or hot-forming).

The assembling of the single units to each other is carried out in a fast and simple way, without requiring any special equipment, since it requires just the simple insertion (either by a slight forced fit or by means of known blocking means) of the individual units into their pre-arranged location in the main basic unit formed by the housing or cabinet.

More particularly, the cabinet 10 of the dish-washer consists of two half-shells or box-like bodies 12 and 14; the inner half-shell 14 (FIG. 2) forms the dish-carrier bay, while the outer half-shell 12 forms the exposed protection element.

The two half-shells 12 and 14 are obtained by pressure molding and the assembly of the inner shell and the outer shell is achieved by means of fastening elements which also act as spacers; between the two bodies 12 and 14 there is a hollow space or interspace 16. Also according to this invention, the cabinet may also be obtained in one single piece by either injection molding, sandwich forming, or by pressure molding of semi-expandable materials, as well as by rotation molding.

In all instances the cabinet 10 is obtained complete with water-conveying ducts (as will be more fully described further on) and internally subdivided into three spaces or bays:

an upper bay 18, defined by a partition element 24, which receives and holds the electrical controls carrying unit 26; a central space or bay 20 (or basin) for the two dish-receiving drawer units 29 and 30 and, in the lower part of the cabinet, a space or bay 22 into which is inserted the hydraulic unit 32.

The functional hydraulic unit 32 (FIG. 2) is preferably obtained by injection molding. It consists substantially of a thermoplastic block or unit into which, during the molding operation, are made all the ducts, seats and basins necessary for the circulation of the water and for fixing or holding the electric pumps and the electrovalves. More particularly, in the hydraulic unit 32 an inlet duct 34 is arranged for the water coming from the water mains, a discharging or exhaust duct 36, and the header-distributor 38 with lines branching off to the three seats 40, 42 and 44 of the electro-valves.

Moreover, in unit 32 there is provided a basin 19 for the salt, a basin 48 for the ion-exchanging resins and the corresponding seats 50 and 52 for the monodirectional valves; in the upper part of unit 32 a basin 54 is provided containing the cold and hot washing water with the corresponding ducts connecting seats 56 and 58 for the discharging and loading pumps. Finally, in this unit there is provided a vertical duct 60, connected with the discharge 36 and a basin 62 which, as will be seen later on, serves for collecting the condensate of the steam coming from the central basin or vat 20.

Unit 32, prepared separately, is mounted by slipping it in from the bottom of body 12 and by then fixing it to the base of central basin 20 by fastening brackets 64, 66, 68 etc. to said base. Basin 46 for the salt, is provided with an openable plug or cap, while basin 48 is closed on top by the bottom base of basin 20 itself, after the mounting of the hydraulic unit 32.

With this arrangement conventional pipe fittings are provided between the various elements (pumps-valves-basins) for their installation on the spot.

In the upper bay 18 of the cabinet, as already indicated, there is inserted the electrical unit 26. This may be made preferably by injection molding and this includes the seats and ducts for the timer 70 and switches 72 as well as vat 74 for the detergent (soap) and vat 76 for the polish. Contrary to the traditional dish-washers, in this case the soap and polish are fed not by the flow of the water, but by dosed dropping.

Unit 26 is bench-wired and then inserted into the bay by a slightly forced drive. The electric cables between unit 26 and the electropumps and the valves of the hydraulic unit 32 are made to pass inside suitable conduits or ducts provided in the interspace 16 formed by the two halfshells forming the cabinet.

Figure 4:
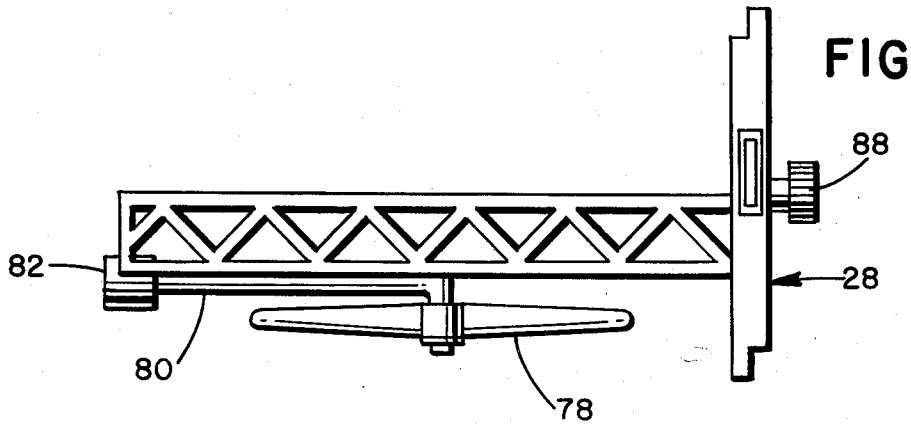
FIG. 4 is a side elevation of the drawer of FIG. 3.
Figure 3:
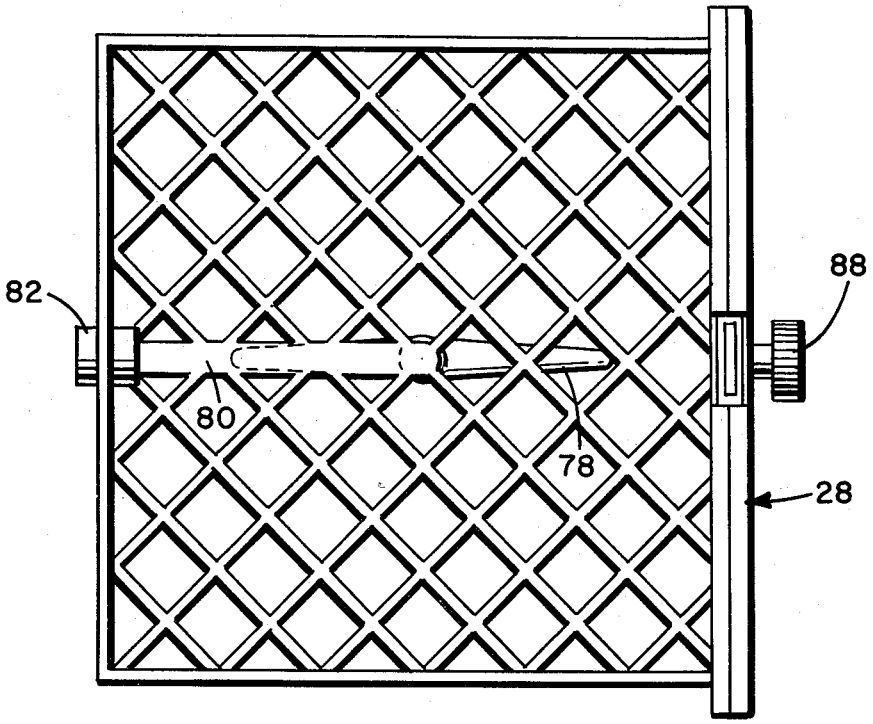
FIG. 3 is a top plan view of a dish-carrying drawer.

In the central space or bay 20 there are inserted two dish-carrying drawers 28 and 30, mounted for sliding on lateral guides (not shown in the figures) and obtained by injection molding (FIGS. 3 and 4). Each drawer (besides incorporating the dish-supporting spacers or rack) incorporates also a rotor 78 (FIG. 4) and corresponding duct 80 for the conveyance of the water.

Figure 5:
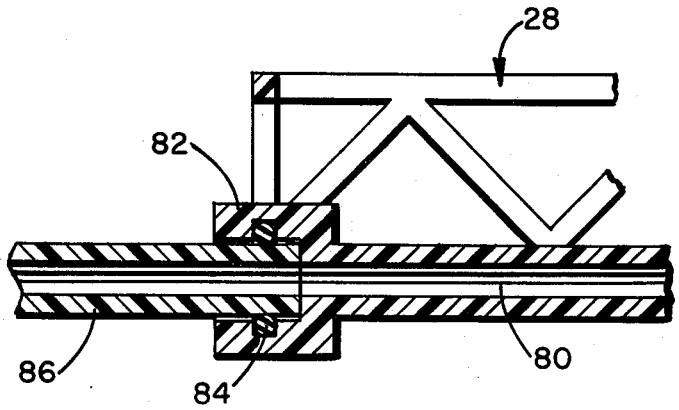
FIG. 5 is a sectional view of a snap-on coupling for connecting dish-carrying drawers to water feed ducts.

FIG. 5 is a sectional detail of snap-on coupling 82 for coupling ducts 80 to water feed conduit 90. Coupling 82 is formed on the end of each duct 80 and contains a gasket 84 which snaps over the end of conduit 86 when drawers 28, 30 are pushed in. Conduits 86 communicate with condenser-feed conduit 90.

Still further according to the invention, the dish-washer is provided with a device for the elimination of hot steam, which often has an unpleasant odor during and after the final heating of the dishes. This device consists of a steam condenser 90, obtained by shaping the conduit 86 into a spiral or the like conduit 39 which connects the feeding electropump 58 with ducts 80 running through the base of the drawers 28, 30. Aseries of opening or ports 90 in a gridlike arrangement or the like, provided in the upper part of the back wall of half-shell 14 (FIG. 2), allows the steam to be exhausted from the central bay 20 and the contact the condenser 90.

Since, however, inside the condenser there is always some cold water (fed into bay 20 before the final heating phase) the emitted steam condenses on the walls of the spiral conduit and the condensate gathers in the lower basin 62, from where it is discharged through ducts 60 and 36.

In this way are eliminated all the unpleasant odors that otherwise might leak out into the outer surroundings.

The advantages offered by the dish-washer according to this invention, besides the low cost, may be thus summarized as follows:

- facility and speed of assembling, including the case of assembling and testing the individual units separately;
- reduction of the number of elements to be assembled and ease of replacement of spare parts;
- greater thermal insulation and absence of steam in the surrounding atmosphere; and
- absence of metal dish-carrying chests or racks, which tend to rust once they have lost their protective coating.

We claim:

1. A dish-washing machine comprising an outer enclosure comprised of thermoplastic material and having an opening at one side thereof;

an inner enclosure comprised of thermoplastic material and having an opening at one side thereof, said inner enclosure being supported within said outer enclosure and being spaced therefrom;

a plurality of functional units each comprised of a thermoplastic material including at least one dish-carrying drawer unit slidably mounted within said inner enclosure, a rotor mounted on said drawer unit for distributing water to the dishes in said dish-carrying drawer unit, and a duct coupled to said rotor;

an electrical control unit located in the space between the upper end of said inner enclosure and said outer enclosure, said control unit being provided with openings for the mounting of electrical components; and an hydraulic unit located in the space between the lower end of said inner enclosure and said outer enclosure, said hydraulic unit being provided with openings for hydraulic components, salt and ion-exchanging resin containers and water adding and distributing conduits; and a vapor condenser located in the space between said inner and outer enclosures connecting said hydraulic components to the duct coupled to the rotor of said dish-carrying drawer unit.

2. A dish-washing machine according to claim 1, comprising two dish-carrying drawer units each having a rotor mounted therein and a duct coupling said vapor condenser to said respective rotor.

3. A dish-washing machine according to claim 1, wherein said outer and inner enclosures are a single molded block formed of semi-expandable thermoplastic materials.

4. A dish-washing machine according to claim 1, wherein said inner enclosure is provided with a plurality of holes to permit steam to pass from the inside of said inner enclosure onto the outer surface of said vapor condenser.

5. A dish-washing machine according to claim 1, which further comprises a condensate-gathering positioned below said vapor condenser and a discharge conduit coupled thereto for carrying away said condensate.

6. A dish-washing machine according to claim 1, wherein said dish-carrying drawer unit is slidably mounted on lateral guides to permit removing said drawer unit from said machine, and wherein there is further provided expanding locking means for locking said drawer unit in the desired position within said inner enclosure.

7. A dish-washing machine according to claim 1, which further comprises a fast snap-on fitting connected to the end of the duct coupled to said rotor for feeding water to said rotor.

8. A dish-washing machine according to claim 1, wherein said electrical components include a timer and switches and wherein said electrical control unit further comprises containers for detergent and polish.

* * * * *